US010994218B2

(12) United States Patent
Kogure

(10) Patent No.: US 10,994,218 B2
(45) Date of Patent: May 4, 2021

(54) ASSEMBLY SET

(71) Applicant: People Co., Ltd., Tokyo (JP)

(72) Inventor: Masako Kogure, Tokyo (JP)

( * ) Notice: Subject to any disclaimer, the term of this patent is extended or adjusted under 35 U.S.C. 154(b) by 198 days.

(21) Appl. No.: 16/080,668

(22) PCT Filed: Sep. 4, 2017

(86) PCT No.: PCT/JP2017/031804
§ 371 (c)(1),
(2) Date: Aug. 29, 2018

(87) PCT Pub. No.: WO2018/220875
PCT Pub. Date: Dec. 6, 2018

(65) Prior Publication Data

US 2020/0346127 A1 Nov. 5, 2020

(30) Foreign Application Priority Data

May 31, 2017 (JP) ..... JP2017-108307

(51) Int. Cl.
*A63H 33/08* (2006.01)

(52) U.S. Cl.
CPC ..... *A63H 33/08* (2013.01)

(58) Field of Classification Search
CPC .... A63H 33/065; A63H 33/08; A63H 33/086; A63H 33/088
USPC ..... 446/124, 125, 126, 128
See application file for complete search history.

(56) References Cited

U.S. PATENT DOCUMENTS 3,487,579 A * 1/1970 Brettingen ..... A63H 33/086 446/128
3,605,322 A * 9/1971 Takashi ..... A63H 33/086 446/128
4,037,978 A * 7/1977 Connelly ..... F16B 7/04 403/164

(Continued)

FOREIGN PATENT DOCUMENTS

CN 103505887 1/2014
CN 105363220 3/2016

(Continued)

OTHER PUBLICATIONS

International Search Report, dated Nov. 21, 2017 for PCT/JP2017/031804.

(Continued)

*Primary Examiner* — Joseph B Baldori
(74) *Attorney, Agent, or Firm* — Soei Patent & Law Firm

(57) ABSTRACT

An assembly set includes a base member that has a pair of cylindrical parts and a connection part, a connector member, and a rod member. Each of the cylindrical parts has a first columnar protrusion protruding from one end and a first cylindrical boss portion positioned within the cylindrical part. The first protrusion of another base member is fitted between an inner peripheral surface of the cylindrical part and the first boss portion. The rod member has a pair of coupling parts fitted into the connector member and a rod part connecting the pair of coupling parts. The connector member has a second columnar protrusion fitted into the first boss portion and a pair of second cylindrical boss portions into which the coupling parts are fitted to swingably hold the rod member.

20 Claims, 21 Drawing Sheets

(56) References Cited

U.S. PATENT DOCUMENTS

| | | | | |
|---|---|---|---|---|
| 5,769,681 | A * | 6/1998 | Greenwood, Sr. ... | A63H 33/062 446/120 |
| 9,345,981 | B1 | 5/2016 | Lama | |
| 2011/0045733 | A1 | 2/2011 | Saigo et al. | |
| 2013/0090033 | A1 | 4/2013 | Vollers et al. | |
| 2013/0252504 | A1 | 9/2013 | Chang et al. | |
| 2015/0314210 | A1 | 11/2015 | Lama et al. | |
| 2016/0346708 | A1 | 12/2016 | Yim | |

FOREIGN PATENT DOCUMENTS

| | | |
|---|---|---|
| CN | 105980024 | 9/2016 |
| DE | 102007038883 | 2/2009 |
| GB | 2505430 | 3/2014 |
| JP | S46-014182 | 5/1971 |
| JP | S54-166995 | 11/1979 |
| JP | 2004-222858 | 8/2004 |
| JP | 2010-172568 | 8/2010 |
| JP | 2015-226748 | 12/2015 |
| JP | 2016-101219 | 6/2016 |
| KR | 10-2014-0032118 | 3/2014 |
| WO | 95/008376 | 3/1995 |

OTHER PUBLICATIONS

International Preliminary Report on Patentability with Written Opinion dated Dec. 12, 2019 for PCT/JP2017/031804.

International Search Report dated Nov. 7, 2017 for PCT/JP2017/031759.

International Preliminary Report on Patentability with Written Opinion dated Dec. 12, 2019 for PCT/JP2017/031759.

Extended Search Report in corresponding European Application No. 17911511.8, dated May 14, 2020.

Soei Patent and Law Firm, Statement of Related Matters, dated Dec. 8, 20220.

* cited by examiner

ASSEMBLY SET

CROSS-REFERENCE TO RELATED APPLICATIONS

This application is a U.S. National Phase patent application of PCT Application No. PCT/JP2017/031804, filed Sep. 4, 2017 which claims the benefit of priority from Japanese Patent Application No. 2017-108307, filed May 31, 2017.

TECHNICAL FIELD

The present invention relates to an assembly set that is assembled by coupling a plurality of members.

BACKGROUND ART

Patent Literature 1 describes an assembly structure in which two cylindrical parts are coupled together. In the assembly structure, each of the cylindrical parts has protrusions at one end and has an annular boss at the other end on the inner periphery. A plurality of assembly structures can be assembled by fitting protrusions of another assembly structure between an inner peripheral surface of the cylindrical part and the boss. In addition, the assembly structure is designed such that two assembly structures can be coupled together to cross each other by connecting smoothly the two cylindrical parts. This makes it possible to create organic-looking forms imitating animal skeletons. In addition, the assembled assembly structures can rotate with respect to each other.

CITATION LIST

Patent Literature

Patent Literature 1: Japanese Unexamined Patent Publication No. 2016-101219

SUMMARY OF INVENTION

Technical Problem

However, the assembly structure described in Patent Literature 1 is designed to stack the same assemble structures. Accordingly, assembling the assembly structures into three-dimensional shapes would require a high degree of skill, and there is a limitation on variations in assembled shapes.

Accordingly, one aspect of the present invention has an object to provide an assembly set that allows easy three-dimensional assembly and increases variations in assembled shapes.

Solution to Problem

The assembly set according to one aspect of the present invention includes a base member that has a pair of cylindrical parts formed in a cylindrical shape with one end closed and a connection part connecting the pair of cylindrical parts, a connector member coupled to the base member, and a rod member coupled to the connector member. Each of the cylindrical parts has a first columnar protrusion protruding from the one end and a first cylindrical boss portion positioned within the cylindrical part. The first protrusion of another base member is fitted between an inner peripheral surface of the cylindrical part and the first boss portion. The rod member has a pair of coupling parts fitted into the connector member and a rod part connecting the pair of coupling parts. The connector member has a second columnar protrusion fitted into the first boss portion and a pair of second cylindrical boss portions into which the coupling parts are fitted to swingably hold the rod member.

In the assembly set, two base members can be coupled together such that the cylindrical parts overlap by fitting the protrusions of the other base member between the inner peripheral surface of the cylindrical part and the first boss portion of the base member. In addition, the rod member and the connector member can be coupled together by fitting the coupling parts of the rod member into the second boss portions of the connector member. The connector member and the base member can be coupled together by fitting the second protrusion of the connector member into the first boss portion of the base member. Accordingly, a plurality of base members can be aligned in the coupling direction of the rod member and the connector member by coupling a plurality of rod members to the base members and coupling the base members to the connector members, for example. In addition, the second boss portions swingably hold the rod member, which causes a difference between the direction of the base member coupled to the connector member coupled to one coupling part of the rod member and the direction of the base member coupled to the connector member coupled to the other coupling part of the rod member. This allows easy three-dimensional assembly and increases variations in assembled shapes.

The paired second boss portions may extend in opposite directions along a reference line of the connector member, and the second protrusion may extend in a direction orthogonal to the reference line. In the assembly set, the paired second boss portions extend in the opposite directions along the reference line, which makes it possible to couple the rod member and the connector member on a straight line. In addition, the second protrusion extends in the direction orthogonal to the reference line, which allows the direction of coupling the rod member to the connector member and the direction of coupling the base member to the connector member to be orthogonal to each other. This makes it easy to couple the rod member and the base member to the connector member.

When the reference lines of two connector members coupled to the rod member are aligned on a straight line, a pitch of the second protrusions of the two connector members may be equal to a pitch of the first boss portions of the paired cylindrical parts of the base member. In the assembly set, when two connector members are coupled to the rod member such that the reference lines of the two connector members are aligned on a straight line, the pitch of the second protrusions of the two connector members is equal to the pitch of the first boss portions of the paired cylindrical parts of the base member. This makes it easy to fit the second protrusions of the two connector members into the first boss portions of the paired cylindrical parts of the base member and arrange the paired cylindrical parts of the base member in the coupling direction of the rod member and the connector member. In addition, the swinging of the rod member with respect to the connector member is restricted at the place coupled to the base member, but the swinging of the rod member with respect to the connector member is not restricted at the place not coupled to the base member. This further allows easy three-dimensional assembly and further increases variations in assembled shapes.

The connector member may have four second protrusions extending in directions orthogonal to each other around the reference line. In the assembly set, the four second protrusions of the connector member extend in the directions orthogonal to each other around the reference line, which makes it possible to couple the base member to at least one of the four sides of the connector member. In addition, two each of the second protrusions extend in opposite directions, which makes it possible to couple the base members to both sides of the connector member. This further allows easy three-dimensional assembly and further increases variations in assembled shapes.

An inner peripheral surface of the first boss portion may have three flat face portions that correspond to three sides of a triangle and separate from one another and three arced face portions configured to connect the adjacent flat face portions. In the assembly set, the inner peripheral surface of the first boss portion has the three flat face portions separated from one another and the three arced face portions connecting the adjacent flat face portions. Accordingly, the first protrusion of the connector member fitted into the first boss portion is held by the three flat face portions from three directions without contacting the three arced face portions. This decreases the contact area between the first protrusion and the first boss portion to suppress generation of excessive frictional force between the first boss portion and the first protrusion. As a result, the base member can be rotated by light force with respect to the connector member, for example. In addition, the adjacent flat face portions are connected by the arced face portions to avoid excessive thinness of the first boss portion. This makes it possible to avoid breakage of the first boss portion into which the first protrusion is fitted.

The first boss portion may be fitted into the second boss portion. In the assembly set, the first boss portion can be fitted into the second boss portion to further increase coupling variations of the base member and the connector member.

The central axis line of the first boss portion aligns with the central axis line of the cylindrical part. The cylindrical part may have three first protrusions. The three first protrusions may be arranged at equal distances from the central axis line of the cylindrical part and spaced at equal intervals around the central axis line of the cylindrical part. In the assembly set, the central axis line of the first boss portion aligns with the central axis line of the cylindrical part, and the three first protrusions are arranged at equal distances from the central axis line of the cylindrical part and spaced at equal intervals around the central axis line of the cylindrical part. Accordingly, fitting the three first protrusions between the inner peripheral surface of the cylindrical part and the first boss portion of another base member makes it possible to align the central axis lines of the two coupled cylindrical parts and rotate the two base members around the central axis lines of the cylindrical parts.

The coupling part may be formed in a spherical shape, and an inner peripheral surface of the second boss portion may be formed in a spherical shape. In the assembly set, the coupling part is formed in a spherical shape, and the inner peripheral surface of the second boss portion is formed in a spherical shape, which allows the coupling part to be smoothly moved with respect to the second boss portion. This makes it possible to swing the rod part smoothly with respect to the connector member.

Advantageous Effects of Invention

According to one aspect of the present invention, it is possible to allow easy three-dimensional assembly and increase variations in assembled shapes.

DESCRIPTION OF EMBODIMENTS

Figure 1:
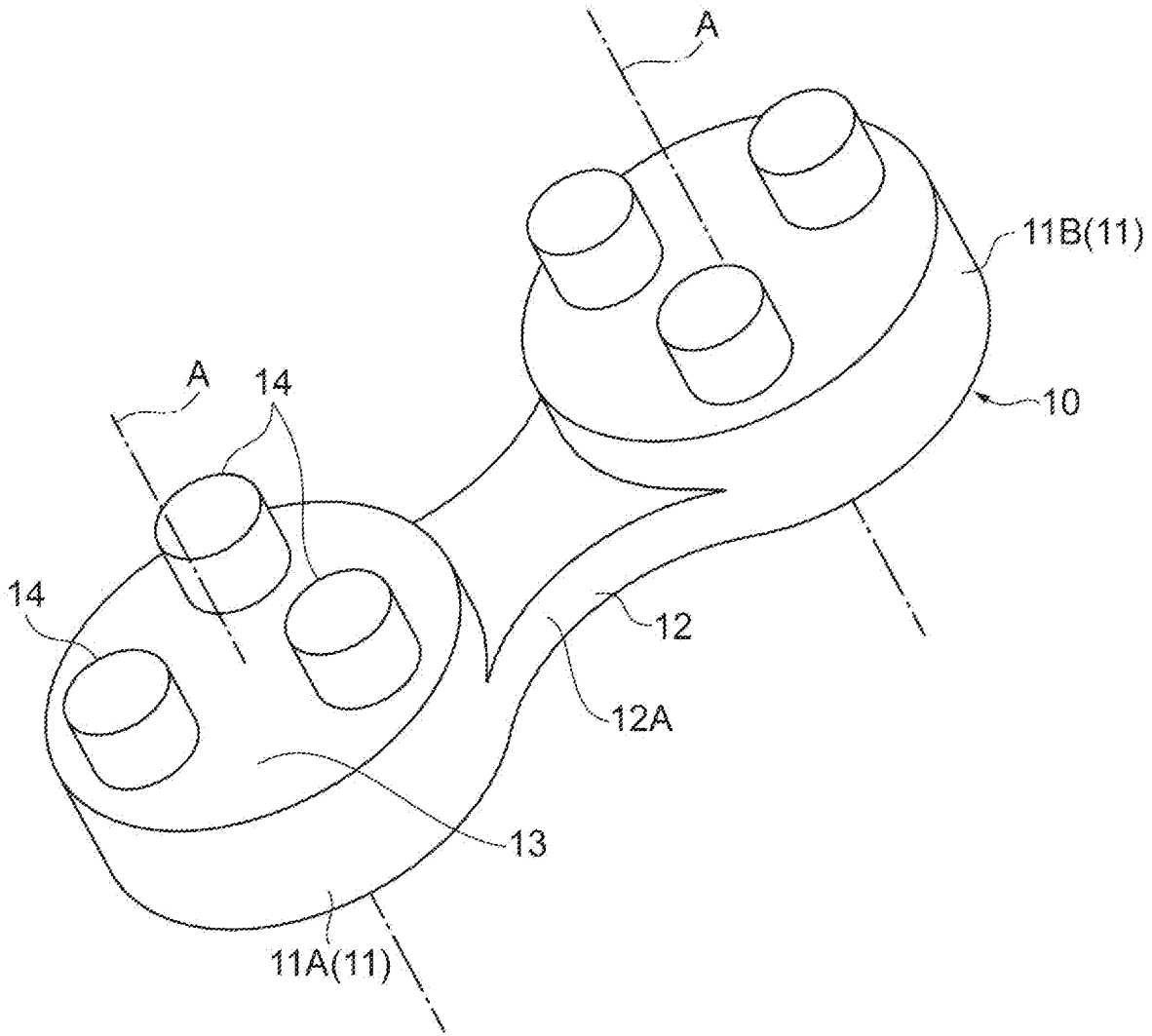
FIG. 1 is a perspective view of a base member in an assembly set according to an embodiment.
Figure 2:
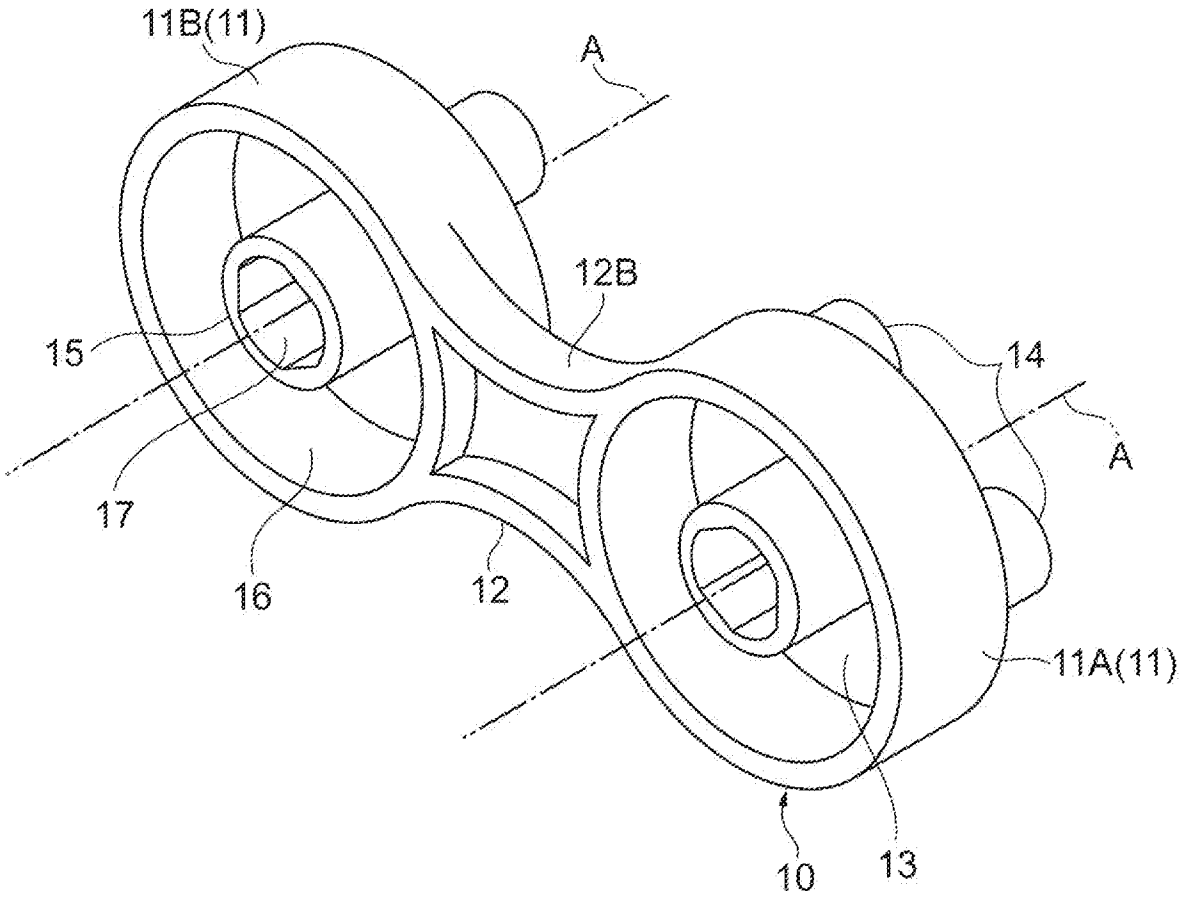
FIG. 2 is a perspective view of the base member in the assembly set according to the embodiment.
Figure 3:
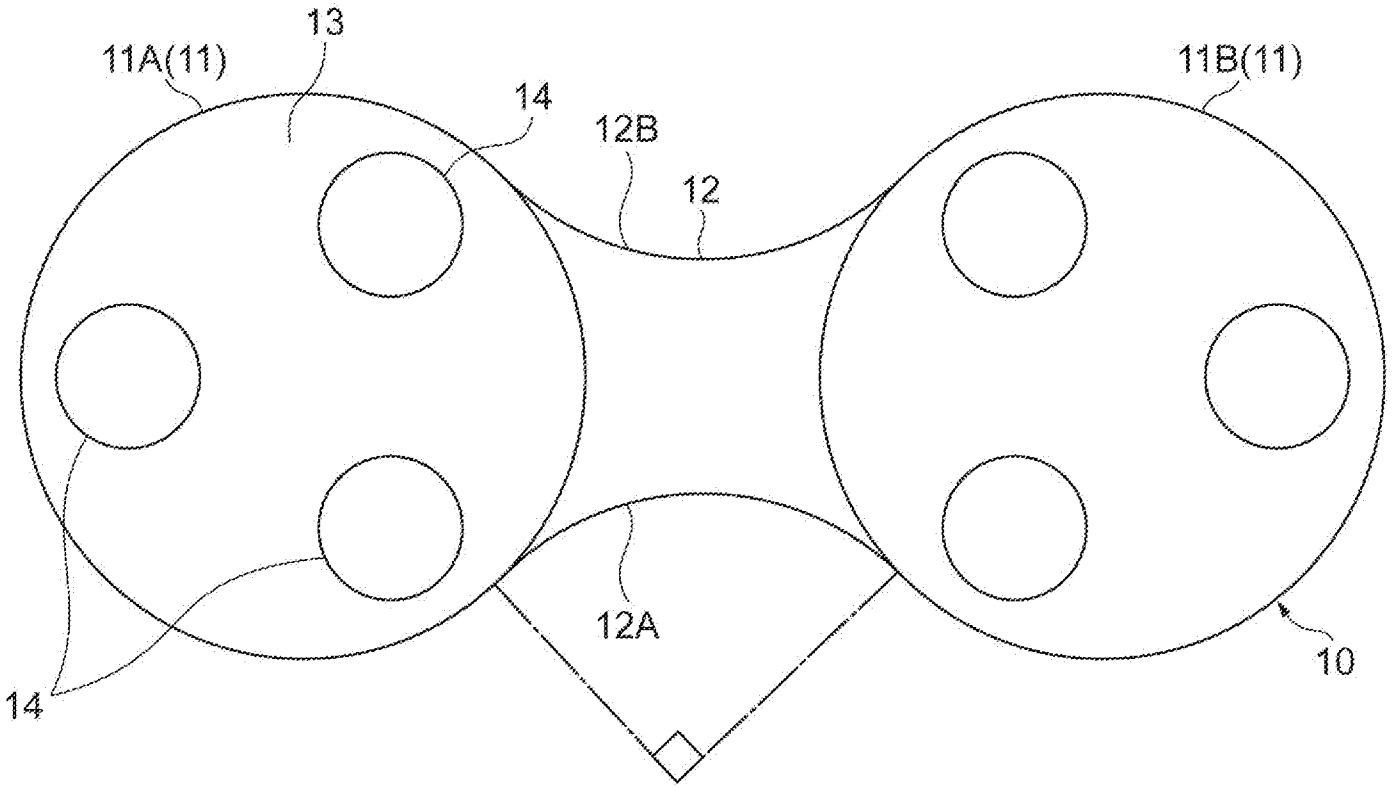
FIG. 3 is a plan view of the base member in the assembly set according to the embodiment.
Figure 4:
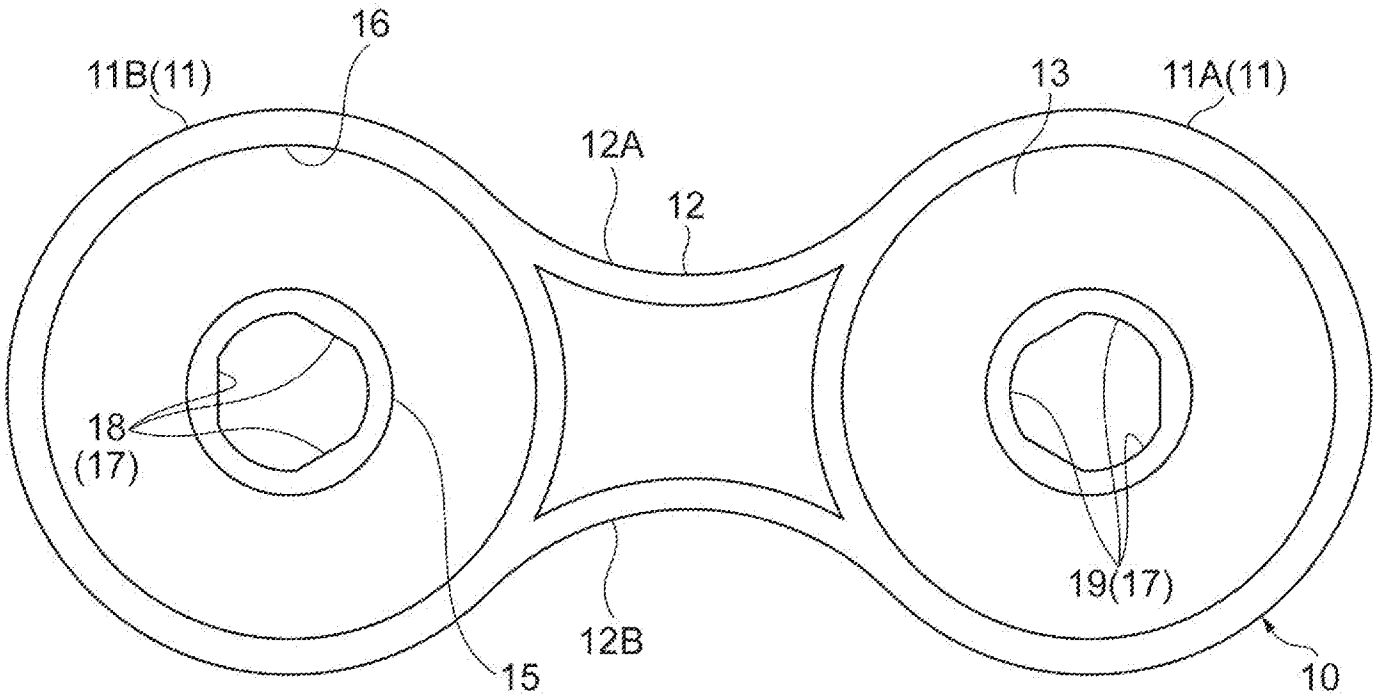
FIG. 4 is a bottom view of the base member in the assembly set according to the embodiment.

Preferred embodiment of an assembly set according to the present invention will be described below in detail with reference to the drawings. Identical or equivalent components illustrated in the drawings are given the same reference signs. The numerical ranges described with the word "to" herein refer to the ranges including the numerical values before and after the word "to" as minimum values and maximum values, respectively.

An assembly set 1 according to the embodiment includes one or more base members 10, one or more connector members 30 coupled to the base member 10, and one or more rod members 20 coupled to the connector member 30.

The assembly set 1 is an assembly toy that is played by assembling these members, for example. There is no particular limitation on material for the base member 10, the connector member 30, and the rod member 20, but the material may be a resin such as ABS resin or PLA resin, for example.

[Base Member]

As illustrated in FIGS. 1 to 4, the base member 10 in the assembly set 1 according to the embodiment has a pair of cylindrical parts 11A and 11B with one end closed and a connection part 12 that connects the pair of cylindrical parts 11A and 11B. The paired cylindrical parts 11A and 11B are the same in shape and thus will be collectively referred to as cylindrical part 11 unless they need to be separately described.

Figure 5:
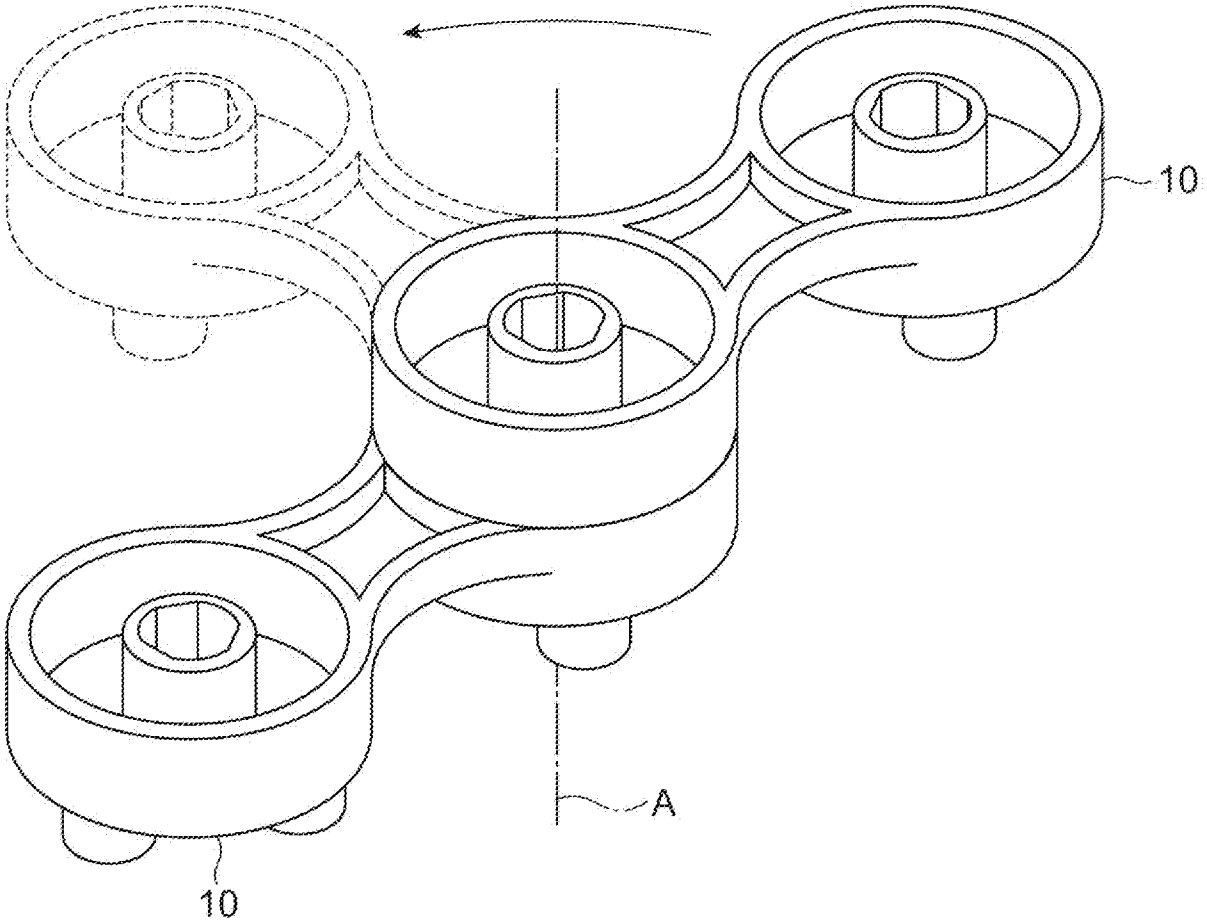
FIG. 5 is a diagram illustrating a coupling example of base members.

Specifically, the cylindrical part 11 serves as a coupling part coupled to the cylindrical part 11 of another base member 10 and the connector member 30. The cylindrical part 11 has one end closed by a flat top face portion 13 and the other end opened. The cylindrical part 11 includes first columnar protrusions 14 that protrude from the one end of the cylindrical part 11 and a first cylindrical boss portion 15 that is positioned in the cylindrical part 11. As illustrated in FIG. 5, the cylindrical part 11 makes it possible to fit the first protrusions 14 of another base member 10 between an inner peripheral surface 16 of the cylindrical part 11 and the first boss portion 15 to couple the two base members 10. The team "fitting" herein means that something is fitted and held in that state.

The first protrusions 14 extend from the outer surface of the top face portion 13 toward the outside of the cylindrical part 11 along a direction parallel to a direction of a central axis line A of the cylindrical part 11. The first protrusions 14 may be formed in a solid columnar shape or a hollow columnar (cylindrical) shape. In the embodiment, the first protrusions 14 are formed in a hollow columnar shape. The cylindrical part 11 has three first protrusions 14. The three first protrusions 14 are the same in shape. The three first protrusions 14 are arranged at equal distances from the central axis line A of the cylindrical part 11 (the radial center of the cylindrical part 11) and spaced at equal intervals (of 120 degrees) around the central axis line A of the cylindrical part 11. That is, the central axis lines of the three first protrusions 14 are parallel to the central axis line A of the cylindrical part 11, and pass through the peaks of a regular triangle with a center of gravity placed on the central axis line A of the cylindrical part 11.

The diameter of a circle circumscribed around the three first protrusions 14 is set to be equal to or slightly larger than the diameter of the inner peripheral surface 16 of the cylindrical part 11, so that the first protrusions 14 of another base member 10 can be fitted between the inner peripheral surface 16 of the cylindrical part 11 and the first boss portion 15. Setting the diameter of the circle circumscribed around the three first protrusions 14 to be slightly larger than the diameter of the inner peripheral surface 16 of the cylindrical part 11 will be referred to overlapping the cylindrical part 11 and the first protrusions 14. The amount of overlap between the cylindrical part 11 and one first protrusion 14 can be set to 0.02 to 0.08 mm, for example, so that the two base members 10 can be rotatably coupled together by a sufficient holding force.

The first boss portion 15 extends from the inner surface of the top face portion 13 toward the inside of the cylindrical part 11 up to the other end of the cylindrical part 11 along a direction parallel to the direction of the central axis line A of the cylindrical part 11. That is, the first boss portion 15 extends in a direction opposite to the first protrusions 14 with respect to the top face portion 13. The cylindrical part 11 has one first boss portion 15. The central axis line of the first boss portion 15 aligns with the central axis line A of the cylindrical part 11. That is, the first boss portion 15 is positioned on the radial center of the cylindrical part 11.

The outer diameter of the first boss portion 15 is set such that the first protrusion 14 of another base member 10 can be fitted between the inner peripheral surface 16 of the cylindrical part 11 and the first boss portion 15. That is, the outer diameter of the first boss portion 15 is identical to or slightly larger than the diameter of a circle inscribed within the three first protrusions 14. Setting the outer diameter of the first boss portion 15 to be slightly larger than the diameter of the circle inscribed within the three first protrusions 14 will be referred to overlapping the first boss portion 15 and the first protrusions 14. The amount of overlap between the first boss portion 15 and one first protrusion 14 can be set to 0.02 to 0.08 mm, for example, so that the two base members 10 can be rotatably coupled together by a sufficient holding force.

An inner peripheral surface 17 of the first boss portion 15 has three flat face portions 18 that correspond to three sides of a triangle and are separated from one another and three arced face portions 19 that connect the adjacent flat face portions 18. Specifically, the three flat face portions 18 correspond to the sides of a regular triangle with a center of gravity placed on the central axis line of the first boss portion 15 (the central axis line A of the cylindrical part 11). The three arced face portions 19 are positioned on the circumference of the same circle centered around the central axis line of the first boss portion 15 (the central axis line A of the cylindrical part 11). The diameter of a circle inscribed within the three flat face portions 18 is smaller than the diameter of the three arced face portions 19. Accordingly, when a columnar member is fitted into the first boss portion 15, for example, this member is in abutment with only the three flat face portions 18 but is not in abutment with the three arced face portions 19.

The connection part 12 has half the dimension of the cylindrical part 11 in a direction parallel to the central axis line A of the cylindrical part 11. The connection part 12 includes a first side surface 12A that extends from the outer peripheral surface of the one cylindrical part 11A to the outer peripheral surface of the other cylindrical part 11B and a second side surface 12B that is on opposite side from the first side surface 12A and extends from the outer peripheral surface of the one cylindrical part 11A to the outer peripheral surface of the other cylindrical part 11B. The first side surface 12A and the second side surface 12B are formed as concave arced surfaces.

Figure 6:
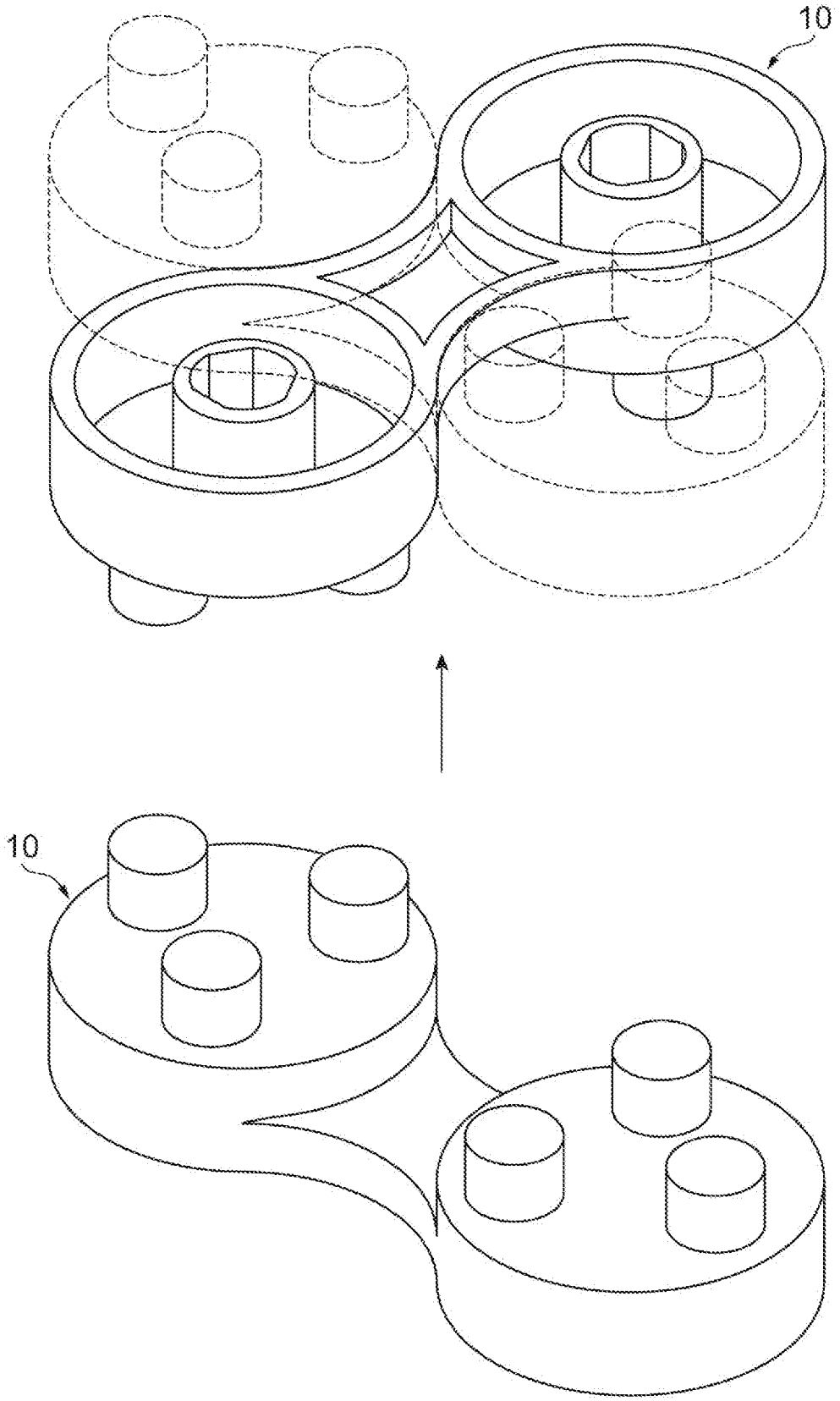
FIG. 6 is a diagram illustrating a coupling example of base members.

The first side surface 12A and the second side surface 12B are arced surfaces identical in radius to the outer peripheral surface of the cylindrical part 11 and having a central angle of 90 degrees. The first side surface 12A and the second side surface 12B have the shortest distance therebetween at the middle point between the one cylindrical part 11A and the other cylindrical part 11B. The shortest distance between the first side surface 12A and the second side surface 12B is identical to the separation distance between the one cylindrical part 11A and the other cylindrical part 11B. Accordingly, as illustrated in FIG. 6, two base members 10 can be coupled together in a cross form by reversing them from each other, rotating them 90 degrees from each other, and approaching them to each other in such a manner as to overlap the connection parts 12.

[Rod Member]

Figure 7:
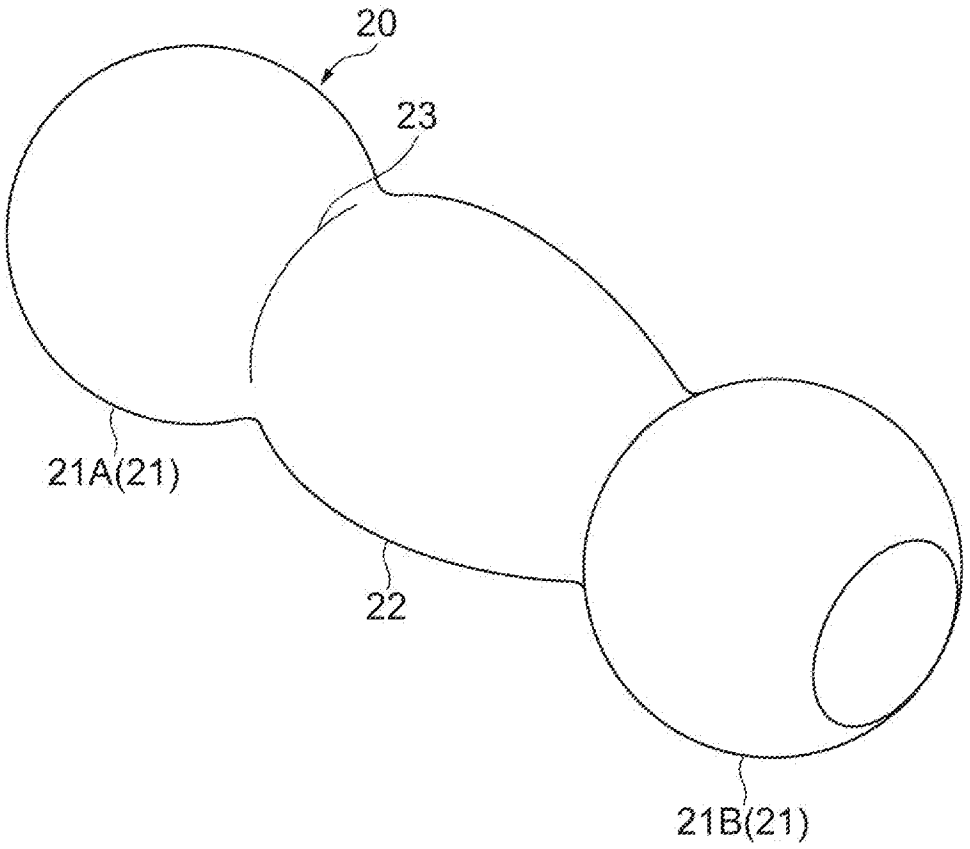
FIG. 7 is a perspective view of a rod member in the assembly set according to the embodiment.
Figure 8:
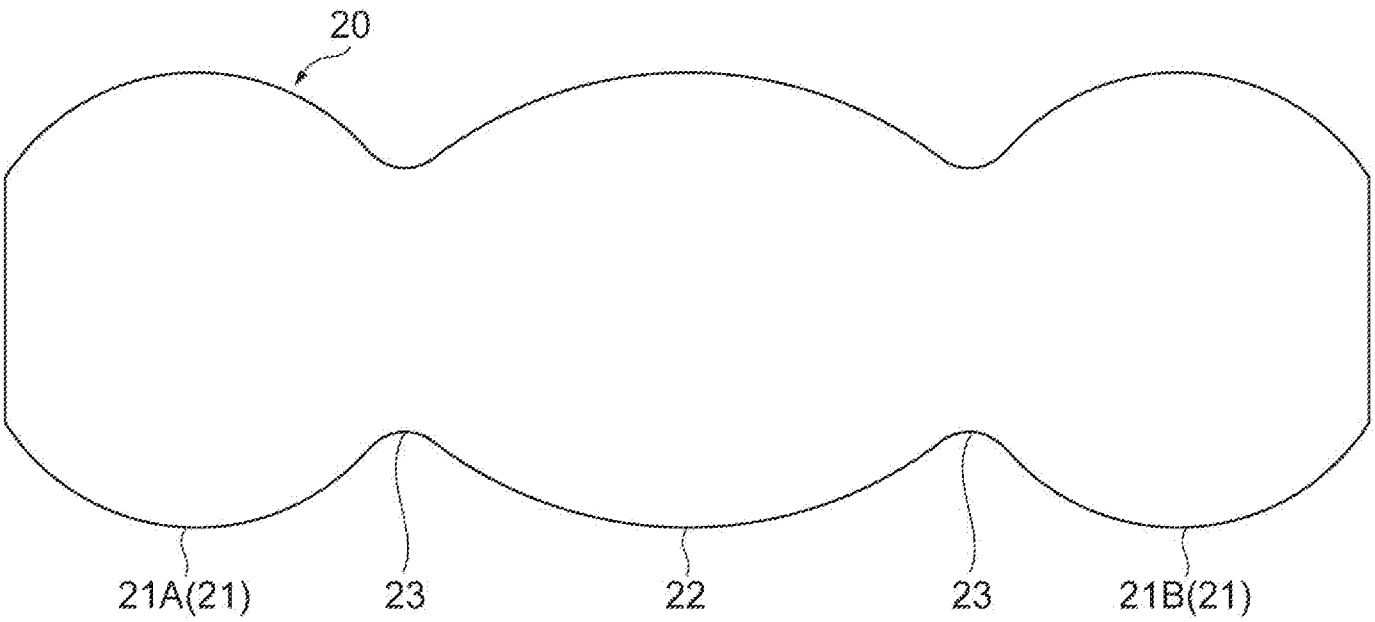
FIG. 8 is a plan view of the rod member in the assembly set according to the embodiment.
Figure 9:
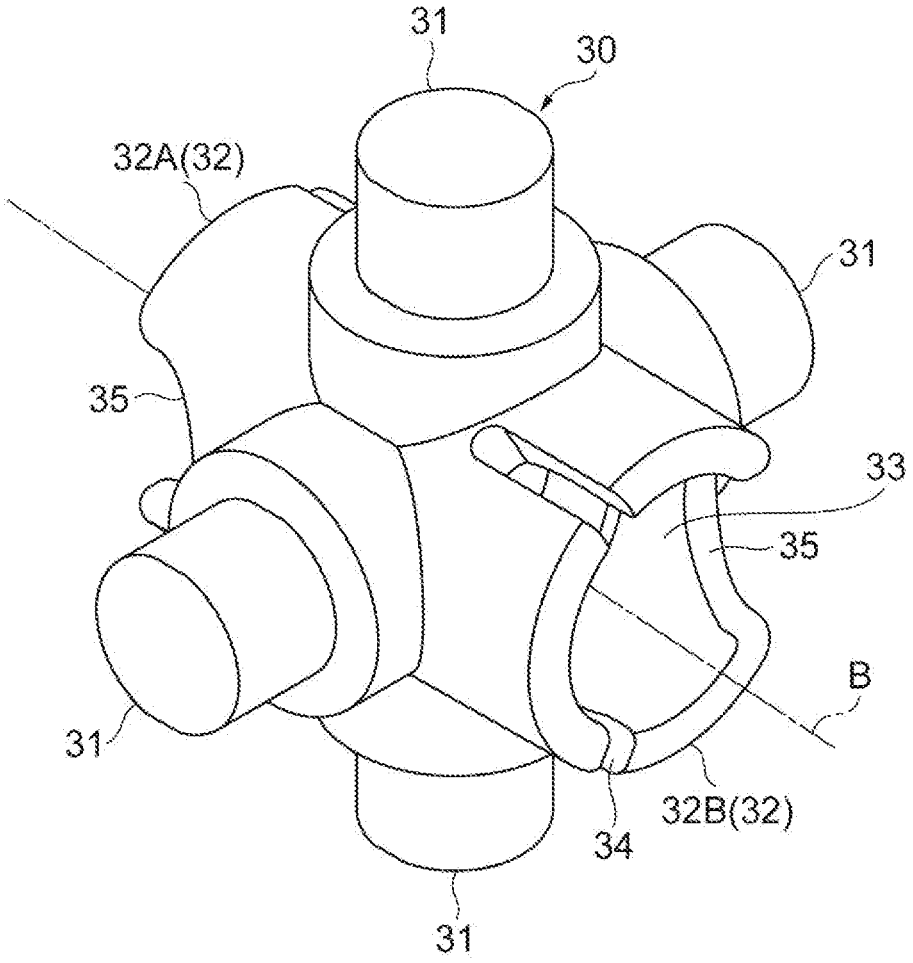
FIG. 9 is a perspective view of a connector member in the assembly set according to the embodiment.
Figure 10:
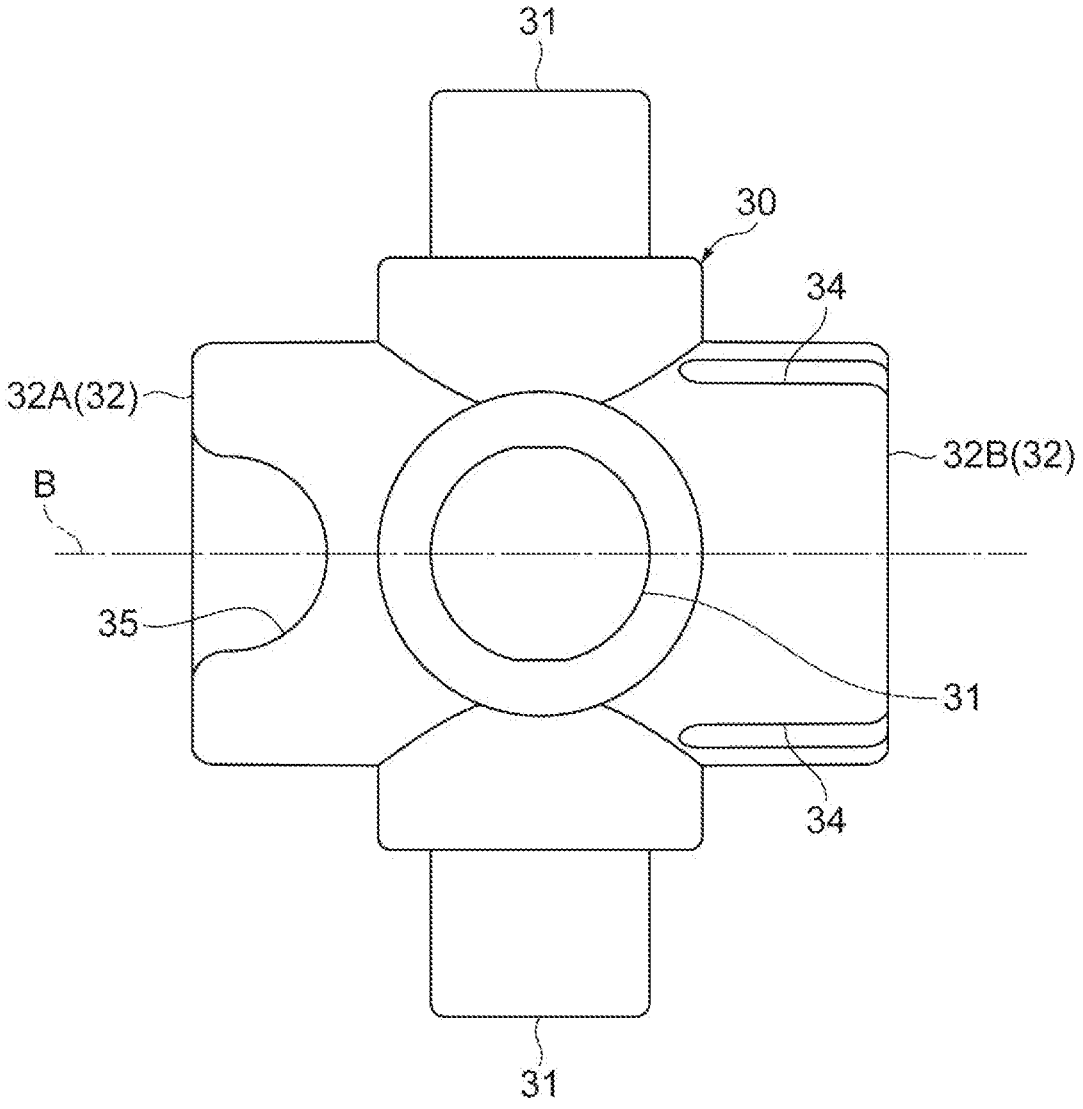
FIG. 10 is a front view of the connector member in the assembly set according to the embodiment.
Figure 11:
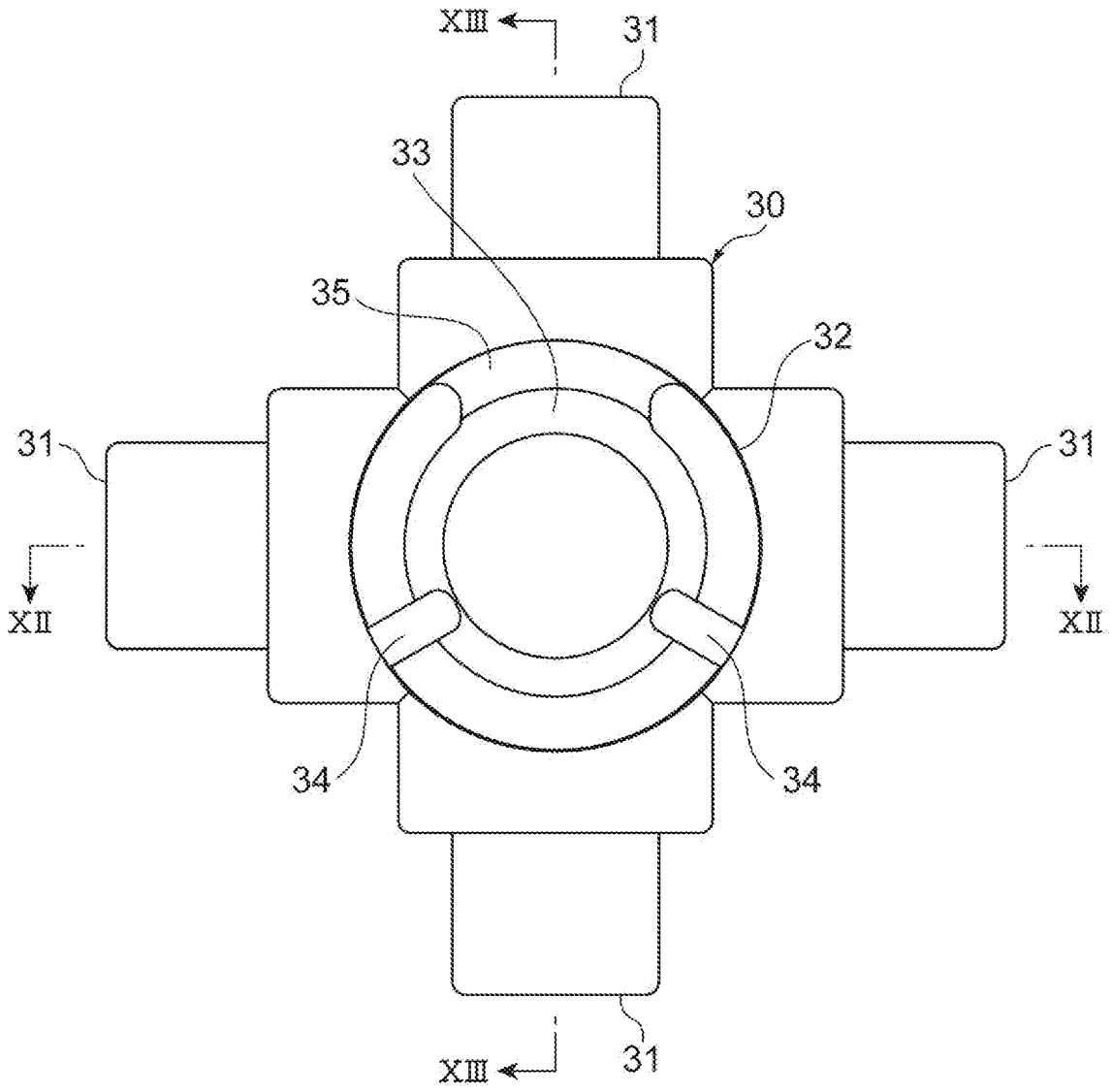
FIG. 11 is a side view of the connector member in the assembly set according to the embodiment.
Figure 12:
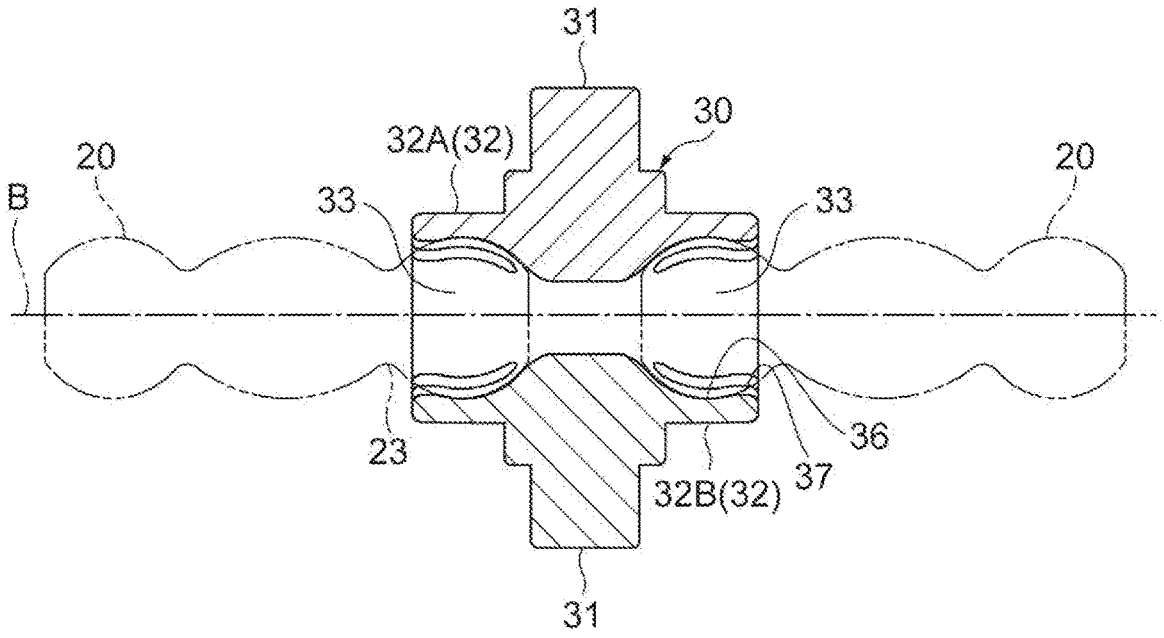
FIG. 12 is a cross-sectional view of FIG. 11 taken along line XII-XII.
Figure 13:
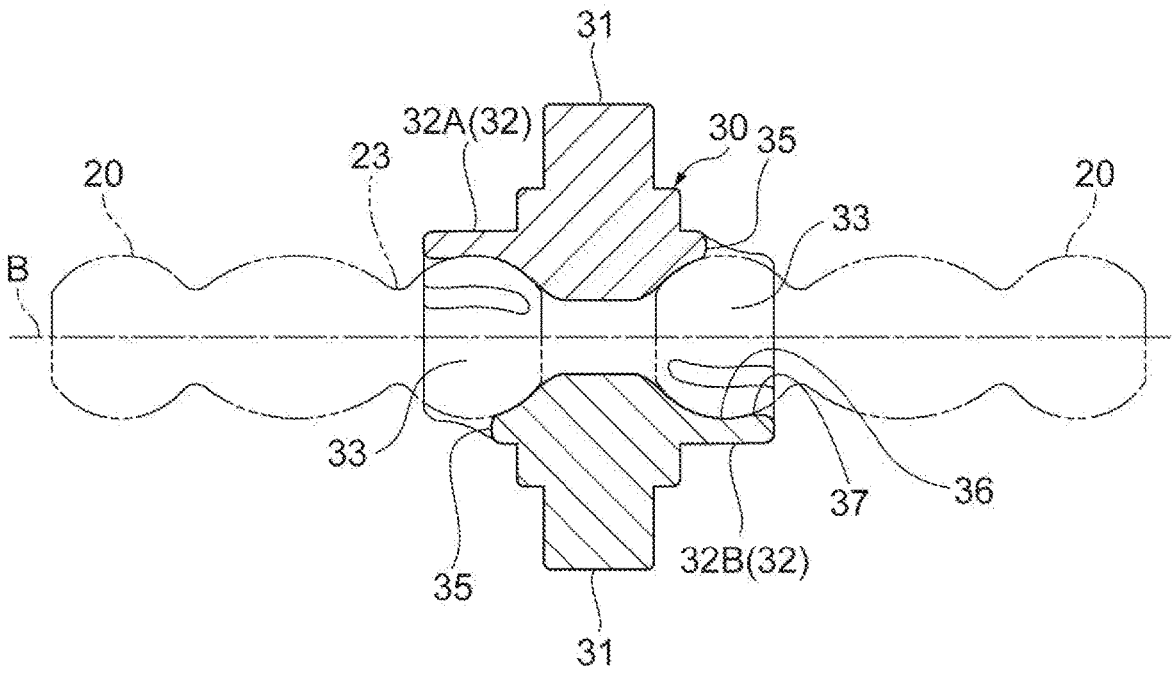
FIG. 13 is a cross-sectional view of FIG. 11 taken along line XIII-XIII.

As illustrated in FIGS. 7 and 8, the rod member 20 of the assembly set 1 according to the embodiment has a pair of coupling parts 21A and 21B that are fitted into the connector members 30 and a rod part 22 that connects the pair of coupling parts 21A and 21B. The paired coupling parts 21A and 21B are the same in shape and thus will be collectively referred to as coupling part 21 unless they need to be separately described.

The coupling part 21 is formed in a spherical shape. When the coupling part 21 is fitted into the connector member 30, the rod part 22 is swingable with respect to the connector member 30.

The rod part 22 is formed in a linearly extending bar shape (columnar shape). The one coupling part 21A and the other coupling part 21B are connected to both ends of the rod part 22. Accordingly, the pair of connector members 30 can be fitted into the rod member 20 in the direction of the axial line of the rod part 22. The position of connection between the coupling part 21 and the rod part 22 is called connection position 23. The rod part 22 is made gradually thicker from the connection position 23 to the middle in the direction of the axial line of the rod part 22, from the viewpoints of rigidity enhancement and ease of gripping the rod part 22. In addition, the rod part 22 may have a groove (not illustrated) from the viewpoint of further increasing ease of gripping the rod part 22. The groove may extend in the direction of the axial line of the rod part 22, for example.

[Connector Member]

As illustrated in FIGS. 9 to 13, the connector member 30 of the assembly set 1 according to the embodiment has a second columnar protrusion 31 that is fitted into the first boss portion 15 of the base member 10 and a pair of cylindrical second boss portions 32A and 32B into which the rod members 20 are fitted to swingably hold the rod members 20. The paired second boss portions 32A and 32B are the same in shape and thus will be collectively referred to as second boss portion 32 unless they need to be separately described.

Specifically, the second protrusions 31 extend in directions orthogonal to a reference line B of the connector member 30. The second protrusions 31 may be formed in a solid columnar shape or a hollow columnar shape (cylindrical shape). In the embodiment, the second protrusions 31 are formed in a solid columnar shape. The connector member 30 includes four second protrusions 31. The four second protrusions 31 are the same in shape. The four second protrusions 31 are arranged at equal intervals (intervals of 90 degrees) around the reference line B. That is, the central axis lines of the two second protrusions 31 adjacent to each other around the reference line B are orthogonal to each other, and the two second protrusions 31 that are located on opposite sides and extend in opposite directions orthogonal to the reference line B. The lengths of the four second protrusions 31 are the same in the directions orthogonal to the reference line B, and the lengths from the reference line B to the ends of the four second protrusions 31 are also the same.

The outer diameter of the second protrusion 31 is the same as or slightly larger than the diameter of the circle inscribed within the three flat face portions 18 of the first boss portion 15 so that the second protrusion 31 can be fitted into the first boss portion 15 of the base member 10. Setting the outer diameter of the second protrusion 31 to be slightly larger than the diameter of the circle inscribed within the three flat face portions 18 of the first boss portion 15 will be referred to overlapping the first boss portion 15 and the second protrusion 31. The amount of overlap between the first boss portion 15 and one second protrusion 31 can be set to 0.02 to 0.08 mm, for example, so that the base member 10 and the connector member 30 can be rotatably coupled together by a sufficient holding force.

The second boss portion 32A and the second boss portion 32B extend in opposite directions along the reference line B. The central axis lines of the second boss portion 32A and the second boss portion 32B align with the reference line B. The lengths of the second boss portion 32A and the second boss portion 32B are the same in the direction of the reference line B, and the lengths from the central axis line of the second protrusion 31 to the leading ends of the second boss portion 32A and the second boss portion 32B are also the same in the direction of the reference line B. In addition, the area between the space on an inner peripheral surface 33 side of the second boss portion 32A and the space on the inner peripheral surface 33 side of the second boss portion 32B may be opened but is preferably sealed from the viewpoints of improving the strength of the connector member 30 to enhance the shape retentivity of the second boss portion 32A and the second boss portion 32B.

The inner peripheral surface 33 of the second boss portion 32 is formed in a spherical shape corresponding to the coupling part 21 of the rod member 20. Specifically, the inner peripheral surface 33 is formed in a spherical shape identical to or slightly smaller than the coupling part 21. There is a maximum diameter position 36 of the inner peripheral surface 33 with the maximum diameter (the diameter of a cross section orthogonal to the reference line B) behind the leading end. This makes it possible to prevent the coupling part 21 fitted into the second boss portion 32 from coming out of the second boss portion 32. In addition, the leading end of the second boss portion 32 has one or more narrow slits 34 to open the leading end of the second boss portion 32. Accordingly, the leading end of the second boss portion 32 serves as a sheet spring, thereby making it possible to fit the coupling part 21 into the second boss portion 32. The drawings illustrate two slits 34.

Figure 14:
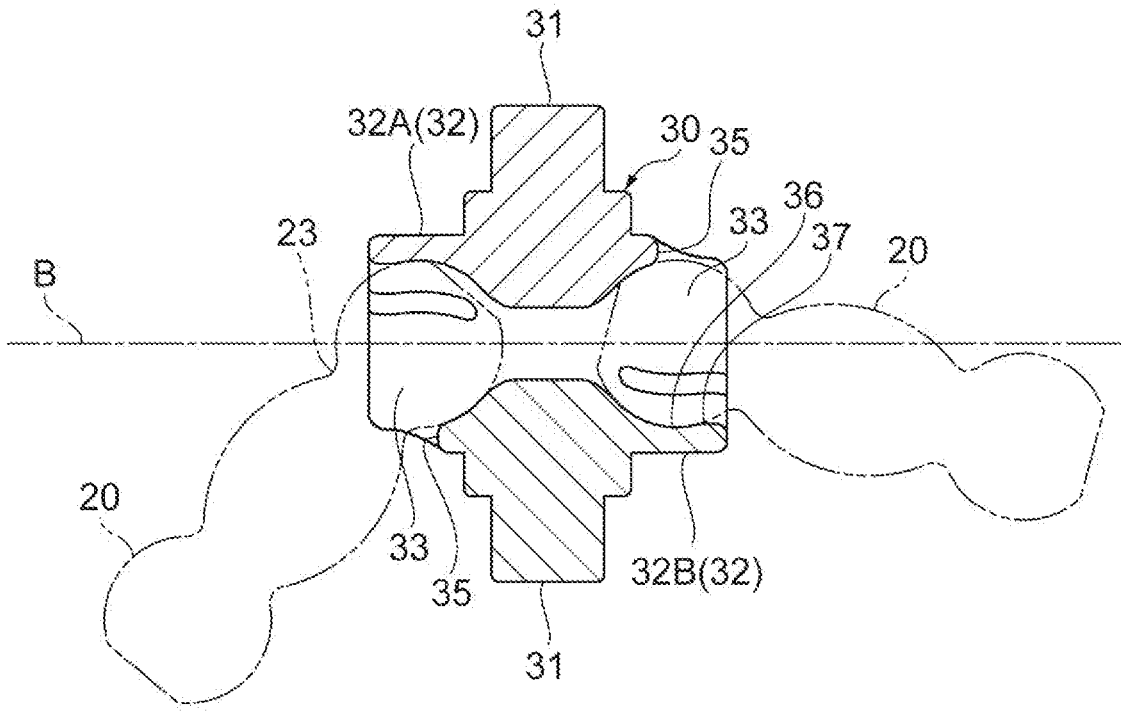
FIG. 14 is a cross-sectional view of the rod member swung with respect to the connector member illustrated in FIG. 13.

The position of the inner peripheral surface 33 with the minimum diameter (the diameter of a cross section orthogonal to the reference line B) nearer the leading end of the second boss portion 32 than the maximum diameter position 36 is called a minimum diameter position 37. The inner diameter of the minimum diameter position 37 is larger than the outer diameter of the connection position 23 of the rod member 20. Accordingly, when the coupling part 21 is fitted into the second boss portion 32, the rod member 20 can swing with respect to the reference line B of the connector member 30 (see FIG. 14). In addition, the leading end of the second boss portion 32 has a cutout 35 into which the connection position 23 of the rod member 20 can enter. The cutout 35 is formed in the same arc shape as the outer shape of the connection position 23 of the rod member 20 or in an arc shape slightly larger than the outer shape of the connection position 23 of the rod member 20. Accordingly, the rod member 20 with the coupling part 21 fitted into the second boss portion 32 can further greatly swing toward the cutout 35 side (see FIG. 14). The cutout 35 splits the leading end of the second boss portion 32 together with the slits 34, and thus the leading end of the second boss portion 32 serves as a sheet spring due to the cutout 35 as well.

The inner diameter of the minimum diameter position 37 of the inner peripheral surface 33 is set to be the same as or slightly smaller than the outer diameter of the first boss portion 15 so that the first boss portion 15 of the base member 10 can be fitted into the second boss portion 32.

[Coupling of the Base Members, the Rod Members, and the Connector Members]

Figure 15:
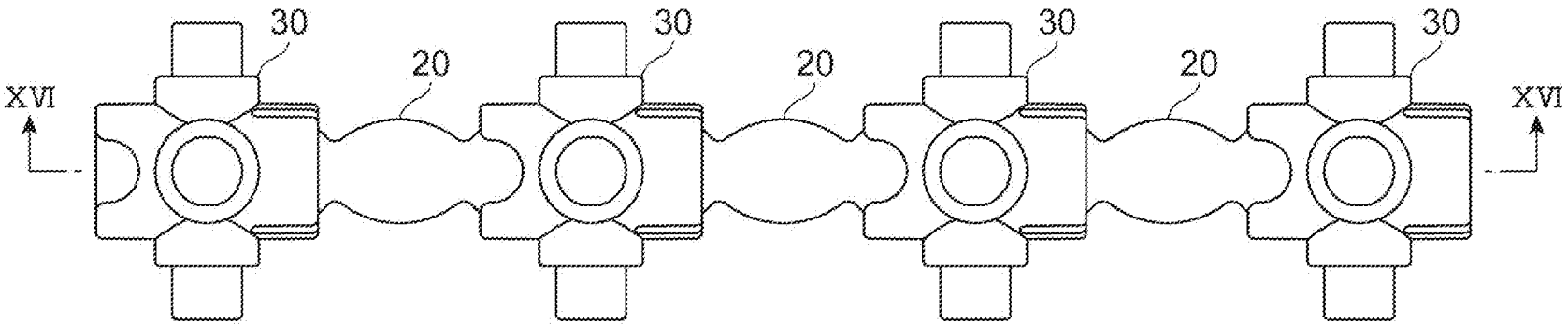
FIG. 15 is a diagram illustrating a coupling example of the rod members and the connector members.
Figure 16:
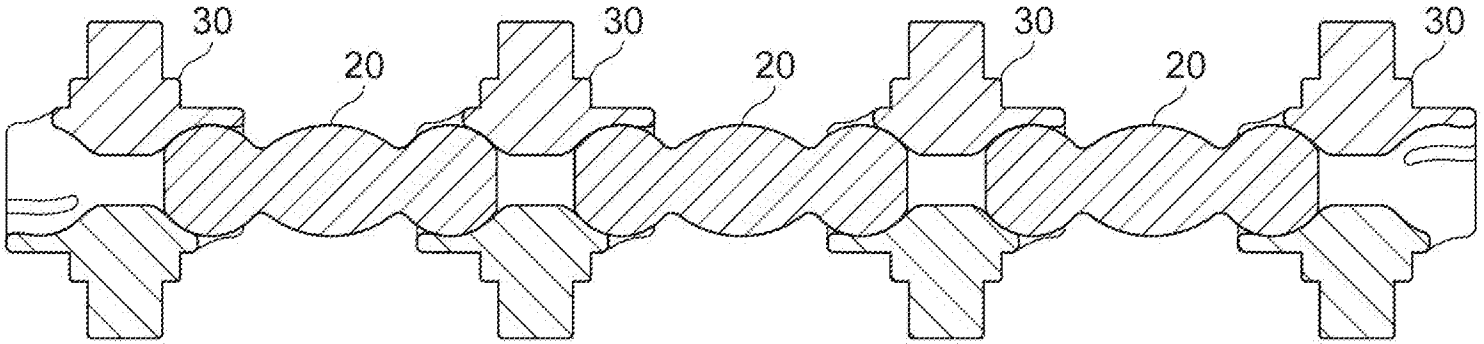
FIG. 16 is a cross-sectional view of FIG. 15 taken along line XVI-XVI.

As illustrated in FIGS. 15 and 16, one or more rod members 20 and one or more connector members 30 can be alternately coupled together by fitting the coupling part 21 of the rod member 20 into the second boss portion 32 of the connector member 30.

Figure 17:
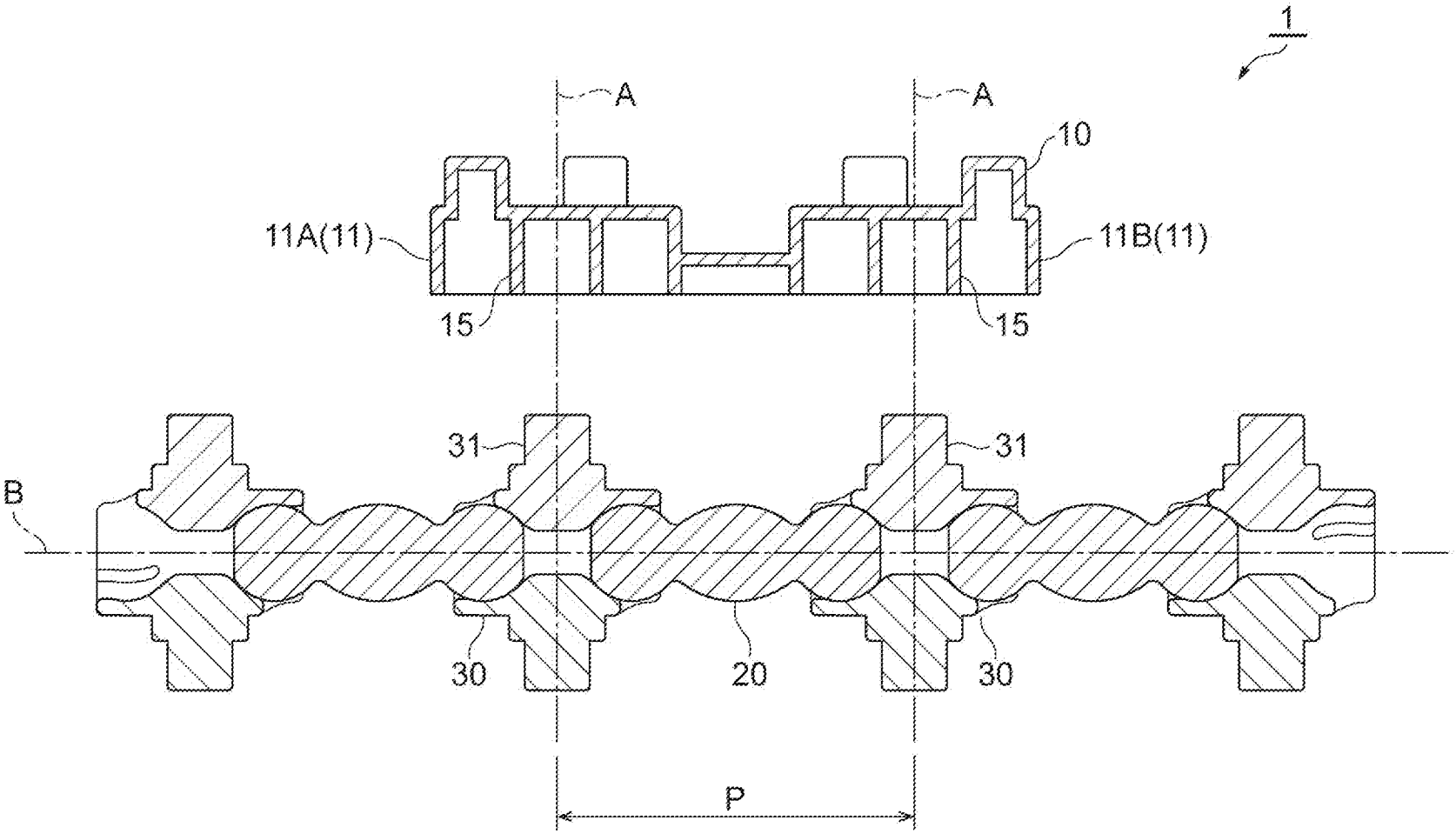
FIG. 17 is a diagram for describing dimensional relationships between the rod member, the connector member, and the base member.

As illustrated in FIG. 17, when the reference lines B of the two connector members 30 coupled to the rod member 20 are aligned on a straight line, the pitch of the second protrusions 31 of the two connector members 30 adjacent to each other via the rod member 20 is equal to pitch P of the first boss portions 15 of the paired cylindrical parts 11A and 11B of the base member 10. The pitch of the second protrusions 31 of the two connector members 30 can be set based on the length of the rod member 20, the length of the second boss portion 32 of the connector member 30, or the like. Accordingly, when the reference lines B of the two connector members 30 coupled to the base member 10 are aligned on a straight line, the second protrusions 31 of the two connector members 30 can be fitted into the paired cylindrical parts 11A and 11B of the base member 10 to couple the base member 10 to the two connector members 30.

Figure 18:
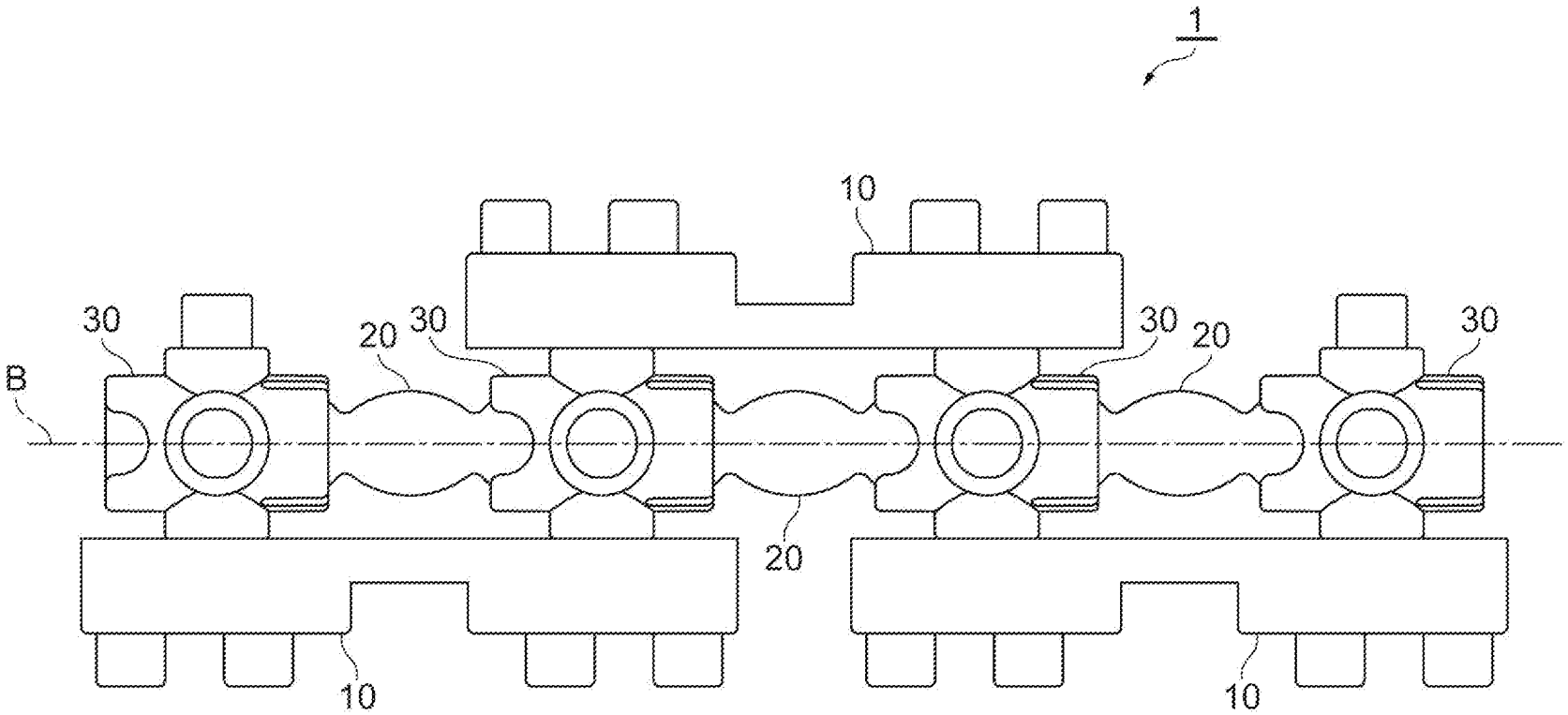
FIG. 18 is a diagram illustrating a coupling example of the base member, the rod member, and the connector member.
Figure 19:
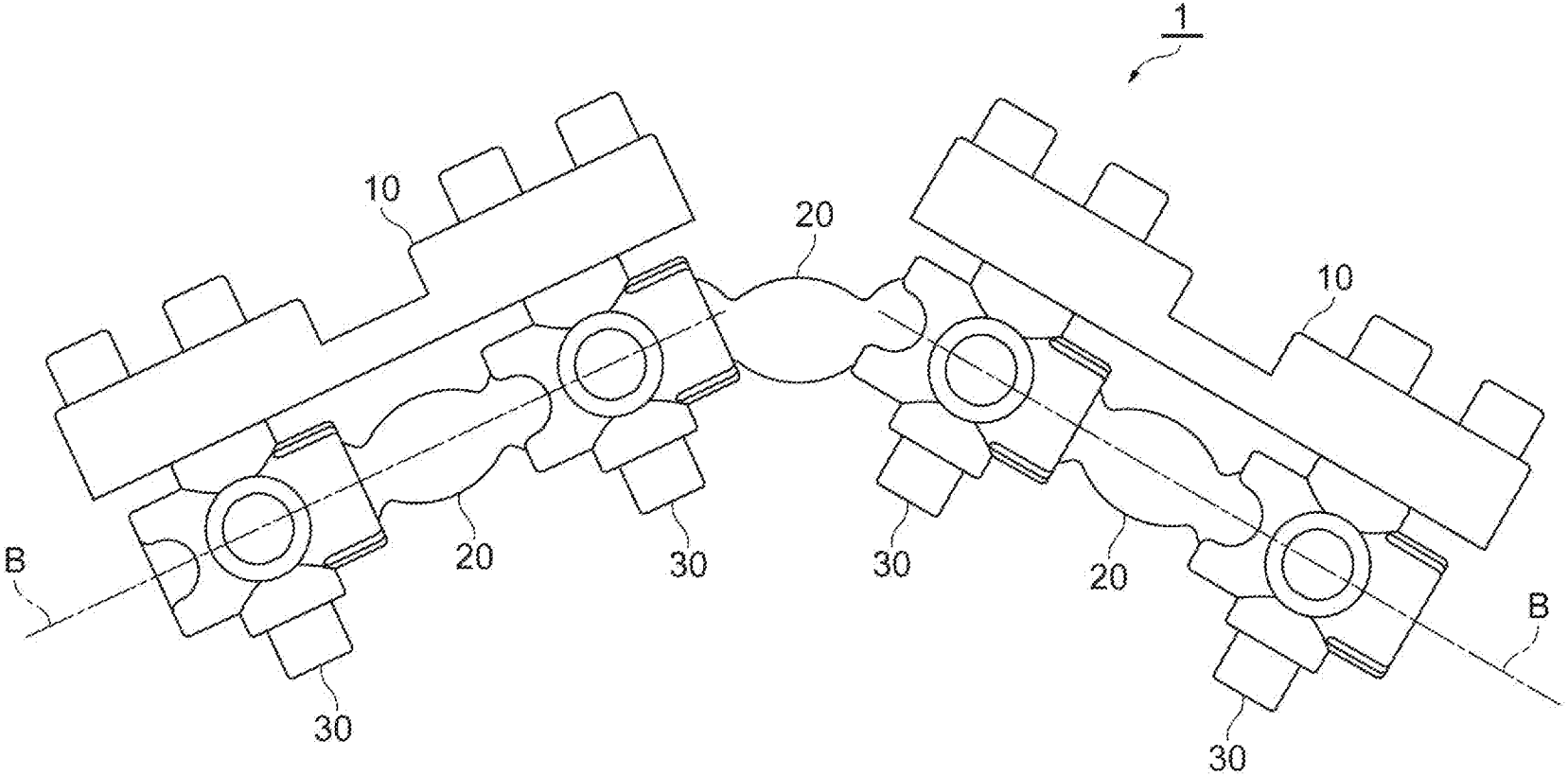
FIG. 19 is a diagram illustrating a coupling example of the base member, the rod member, and the connector member.

In this case, the swinging of the rod member 20 with respect to the connector members 30 is restricted at places which are coupled to the base member 10. Accordingly, as illustrated in FIG. 18, for example, the two connector members 30 and the rod member 20 can be aligned on a straight line along the reference lines B by fitting the second protrusions 31 of the two connector members 30 adjacent to each other via the rod member 20 into the paired cylindrical parts 11A and 11B of the base member 10. Meanwhile, the swinging of the rod member 20 with respect to the connector members 30 is not restricted at places which are not coupled to the base member 10. Accordingly, as illustrated in FIG. 19, for example, setting the places where the two connector members 30 adjacent to each other via the rod member 20 are not coupled to the base member 10 makes it possible to swing the rod member 20 with respect to the connector members 30 at those places and to cause a difference between the directions of the reference lines B of the two adjacent connector members 30.

In this manner, in the assembly set 1 according to the embodiment, the two base members 10 can be coupled together in such a manner as to overlap their cylindrical parts 11 by fitting the first protrusions 14 of the other base member 10 between the inner peripheral surface 16 of the cylindrical part 11 and the first boss portion 15 of the base member 10. In addition, the rod member 20 and the connector member 30 can be coupled together by fitting the coupling part 21 of the rod member 20 into the second boss portion 32 of the connector member 30, and the connector member 30 and the base member 10 can be coupled together by fitting the second protrusion 31 of the connector member 30 into the first boss portion 15 of the base member 10. Accordingly, a plurality of base members 10 can be aligned in the coupling direction of the rod member 20 and the connector member 30 by coupling together a plurality of rod members 20 and a plurality of connector members 30 and coupling together the base members 10 into the connector members 30, for example.

Moreover, the second boss portion 32 swingably holds the rod member 20, which makes it possible to cause a difference between the direction of the base member 10 coupled to the connector member 30 coupled to the one coupling part 21A of the rod member 20 and the direction of the base member 10 coupled to the connector member 30 coupled to the other coupling part 21B of the rod member 20. This allows easy three-dimensional assembly and increases variations in assembled shapes.

In addition, the paired second boss portions 32A and 32B extend in the opposite directions along the reference line B, which makes it possible to couple the rod member 20 and the connector member 30 on a straight line. Further, the second protrusions 31 extend in the directions orthogonal to the reference line B, whereby the direction of coupling the rod member 20 to the connector member 30 and the direction of coupling the base member 10 to the connector member 30 can be orthogonal to each other. This makes it easy to couple the rod member 20 and the base member 10 to the connector member 30.

When the two connector members 30 are coupled to the rod member 20 such that their reference lines B are aligned on a straight line, the pitch of the second protrusions 31 of the two connector members 30 is equal to the pitch P of the first boss portions 15 of the paired cylindrical parts 11A and 11B of the base member 10.

Accordingly, the second protrusions 31 of the two connector members 30 can be easily fitted into the first boss portions 15 of the paired cylindrical parts 11A and 11B of the base member 10, and the paired cylindrical parts 11A and 11B of the base member 10 can be arranged in the coupling direction of the rod member 20 and the connector member 30. In addition, the swinging of the rod member 20 with respect to the connector members 30 is restricted at the places which are coupled to the base member 10, but the swinging of the rod member 20 with respect to the connector members 30 is not restricted at the places which are not coupled to the base member 10. This allows easy three-dimensional assembly and increases variations in assembled shapes.

The four second protrusions 31 of the connector member 30 extend in the directions orthogonal to each other around the reference line B, which makes it possible to couple the base member 10 to at least one of the four sides of the connector member 30. In addition, two of the second protrusions 31 extend in opposite directions, which makes it possible to couple the base members 10 to both sides of the connector member 30. This further allows easy three-dimensional assembly and further increases variations in assembled shapes.

The inner peripheral surface 17 of the first boss portion 15 has the three flat face portions 18 separated from each other and the three arced face portions 19 connecting the adjacent flat face portions 18. Accordingly, the second protrusion 31 of the connector member 30 fitted into the first boss portion 15 is held by the three flat face portions 18 from three directions without contacting the three arced face portions 19. This decreases the contact area between the second protrusion 31 and the first boss portion 15 to suppress generation of excessive frictional force between the first boss portion 15 and the second protrusion 31. As a result, the base member 10 can be rotated by light force with respect to the connector member 30, for example. In addition, the adjacent flat face portions 18 are connected by the arced face portions 19 to avoid excessive thinness of the first boss portion 15. This makes it possible to avoid breakage of the first boss portion 15 when the second protrusion 31 is fitted into the first boss portion 15.

The first boss portion 15 can be fitted into the second boss portion 32, which further increases variations in coupling of the base member 10 and the connector member 30.

The central axis line of the first boss portion 15 aligns with the central axis line A of the cylindrical part 11, and the three first protrusions 14 are arranged at equal distances from the central axis line A of the cylindrical part 11 and are spaced at equal intervals around the central axis line A of the cylindrical part 11. Accordingly, fitting the three first protrusions 14 between the inner peripheral surface 16 of the cylindrical part 11 and the first boss portion 15 of another base member 10 makes it possible to align the central axis lines A of the two coupled cylindrical parts 11 and rotate the two base members 10 around the central axis lines A of the cylindrical parts 11.

The coupling part 21 is formed in a spherical shape, and the inner peripheral surface 33 of the second boss portion 32 is formed in a spherical shape, which allows the coupling part 21 to be smoothly moved with respect to the second boss portion 32. This makes it possible to swing the rod member 20 smoothly with respect to the connector member 30.

Figure 20:
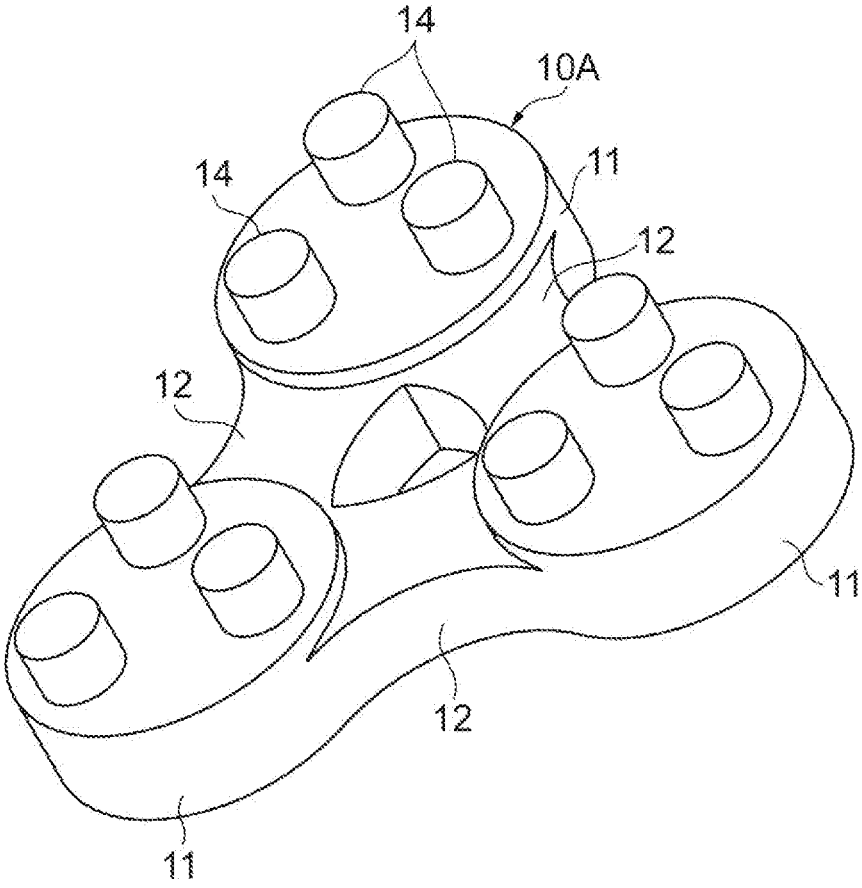
FIG. 20 is a perspective view of a modified example base member.
Figure 21:
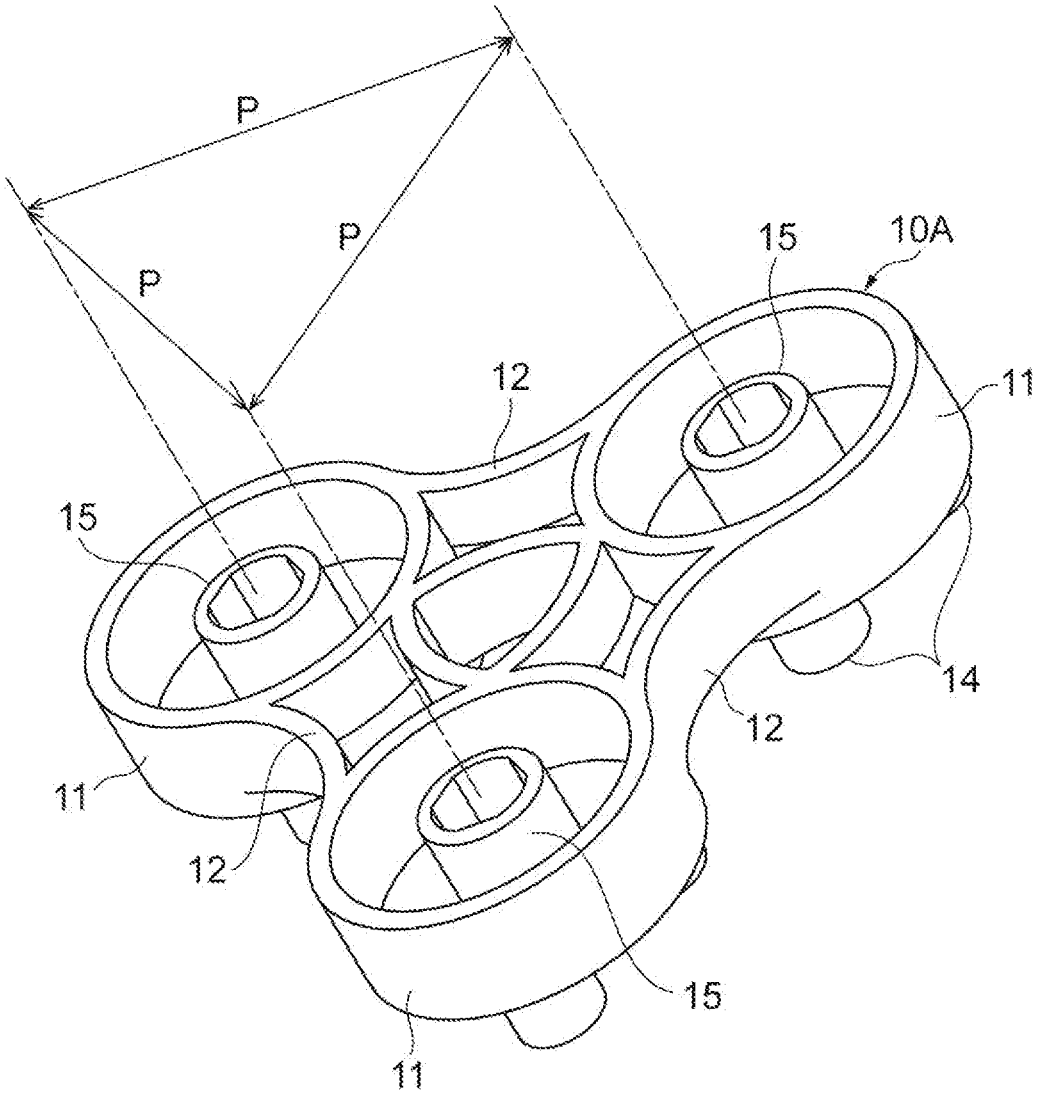
FIG. 21 is a perspective view of a modified example base member.

A preferred embodiment of the present invention has been described so far, but the present invention is not limited to the foregoing embodiment. For example, the base member may have three or more cylindrical parts and may have two or more coupling parts. As an example, as illustrated in FIGS. 20 and 21, a base member 10A may include three cylindrical parts 11 and three connection parts 12 connecting the adjacent two cylindrical parts 11. Each of the three cylindrical parts 11 of the base member 10A includes first protrusions 14 and a first boss portion 15 as in the embodiment above. In this case, as illustrated in FIGS. 17 and 21, when the reference lines B of the two connector members 30 coupled to the rod member 20 are aligned on a straight line, the pitch of the second protrusions 31 of the two connector members 30 is preferably equal to the pitch P of the first boss portions 15 of the paired adjacent cylindrical parts 11 of the base member 10A.

The arrangements and shapes of the constituent elements of the base member, the rod member, and the connector member can be changed as appropriate without deviating from the scope of the claims. For example, in the embodiment described above, when the reference lines of the two connector members coupled to the rod member are aligned on a straight line, the pitch of the second protrusions of the two connector members is equal to the pitch of the first boss portions of the paired cylindrical parts of the base member. Alternatively, these pitches may be different. In this case, when the pitch of the second protrusions of the two connector members is larger than the pitch of the first boss portions of the paired cylindrical parts of the base member, the second protrusions of the two connector members can be fitted into the first boss portions of the paired cylindrical parts of the base member by swinging the rod member with respect to the connector members.

In the embodiment above, the rod part is formed in a linearly extending bar shape. Alternatively, the rod part may be formed in a curved bar shape.

REFERENCE SIGNS LIST

1: Assembly set, 10, 10A: Base member, 11, 11A, 11B: Cylindrical part, 12: Connection part, 12A: First side surface, 12B: Second side surface, 13: Top face portion, 14: First protrusion, 15: First boss portion, 16: Inner peripheral surface, 17: Inner peripheral surface, 18: Flat face portion, 19: Arced face portion, 20: Rod member, 21, 21A, 21B: Coupling part, 22: Rod part, 23: Connection position, 30: Connector member, 31: Second protrusion, 32, 32A, 32B: Second boss portion, 33: Inner peripheral surface, 34: Slit, 35: Cutout, 36: Maximum diameter position, 37: Minimum diameter position, A: Central axis line, B: Reference line, P: Pitch

The invention claimed is:

1. An assembly set comprising:

a base member that has a pair of cylindrical parts formed in a cylindrical shape with one end closed and a connection part connecting the pair of cylindrical parts;

a first connector member configured to be coupled to the base member;

a second connector member configured to be coupled to the base member; and a rod member configured to be coupled to both the first connector member and the second connector member, wherein each of the cylindrical parts has:

a first columnar protrusion protruding from the one end; and a first cylindrical boss portion positioned within the cylindrical part, wherein an inner peripheral surface of the cylindrical part and the first cylindrical boss portion are configured to receive a columnar protrusion of another base member fitted therebetween, the rod member has:

a pair of coupling parts including a first coupling part and a second coupling part; and a rod part connecting the pair of coupling parts, the first connector member has:

a first pair of second cylindrical boss portions into which the first coupling part is configured to be fitted to swingably hold the rod member, the first pair of second cylindrical boss portions extending in opposite directions along a first reference line of the first connector member; and a second columnar protrusion configured to be fitted into the first cylindrical boss portion, the second columnar protrusion extending in a direction orthogonal to the first reference line, the second connector member has an identical shape as the first connector member and includes:

a second pair of second cylindrical boss portions into which the second coupling part is configured to be fitted to swingably hold the rod member, the second pair of second cylindrical boss portions extending in opposite directions along a second reference line; and another second columnar protrusion configured to be fitted into the first cylindrical boss portion, the other second columnar protrusion extending in a direction orthogonal to the second reference line, wherein, when the first coupling part is fitted into one of the first pair of second cylindrical boss portions and the second coupling part is fitted into one of the second pair of second cylindrical boss portions, the rod member is swingable with respect to the first connector member and the second connector member to vary an angle of inclination between the first reference line and the second reference line, and wherein, when the first reference line is aligned with the second reference line, a pitch between the second columnar protrusion of the first connector member and the other second columnar protrusion of the second connector member is equal to a pitch between the pair of cylindrical parts of the base member.

2. The assembly set according to claim 1, wherein the first connector member has two additional columnar second protrusions extending in directions orthogonal to each other around the first reference line.

3. The assembly set according to claim 1, wherein an inner peripheral surface of the first cylindrical boss portion has:

three flat face portions that correspond to three sides of a triangle and are separated from one another; and three arced face portions that connect the adjacent flat face portions.

4. The assembly set according to claim 1, wherein the first cylindrical boss portion is configured to be fitted into one of the second cylindrical boss portions.

5. The assembly set according to claim 1, wherein a central axis of the first cylindrical boss portion aligns with a central axis line of one of the cylindrical parts, each of the cylindrical parts has three columnar protrusions including the first columnar protrusion, and the three columnar protrusions are arranged at equal distances from the central axis line and spaced at equal intervals around the central axis line.

6. The assembly set according to claim 1, wherein each of the coupling parts of the rod member is formed in a spherical shape, and an inner peripheral surface of each of the second cylindrical boss portions of the first connector member and the second connector member is formed in a spherical shape.

7. The assembly set according to claim 1, wherein a middle portion of the rod part in an axial direction of the rod part is thicker than an end portion of the rod part in the axial direction of the rod part.

8. The assembly set according to claim 1, wherein a leading end of each of the second cylindrical boss portions has one or more slits that are configured to expand in response to receiving one of the pair of the coupling parts of the rod member.

9. The assembly set according to claim 1, wherein a leading end of each of the second cylindrical boss portions has a cutout configured to allow one of the pair of the coupling parts of the rod member to enter there through.

10. The assembly set according to claim 1, wherein the rod member is prohibited from swinging with respect to the first connector member and the second connector member when the rod member is coupled to the first connector member and the second connector member, and the base member is coupled to the first connector member and the second connector member.

11. The assembly set according to claim 1, wherein the rod member has an axial centerline which passes through a center of the rod member, wherein the axial center line, the first reference line, and the second reference line are aligned when the rod member is coupled to the first connector member and the second connector member, and the base member is coupled to the first connector member and the second connector member.

12. An assembly set comprising:

a base member including a cylindrical part connected to another cylindrical part by a connection part, wherein the cylindrical part comprises:

a first protrusion extending from a top portion of the cylindrical part, the first protrusion associated with a width; and a first boss at least partially located within the cylindrical part and extending from the top portion in an opposite direction from the first protrusion, the first boss spaced apart from a peripheral wall of the cylindrical part by a distance equal to or less than the width of the first protrusion, wherein the other cylinder part comprises another first boss;

a first connector member configured to be connected to the base member, wherein the first connector member comprises:

a second protrusion configured to be fitted into an opening in the first boss of the cylindrical part; and a first pair of second bosses extending in opposite directions along a first reference line of the first connector member, each of the first pair of second bosses comprising a first spherical shaped cavity; and a second connector member configured to be connected to the base member, wherein the second connector member has an identical shape as the first connector member, and comprises:

another second protrusion configured to be fitted into the opening in the first boss of the cylindrical part; and a second pair of second bosses extending in opposite directions along a second reference line of the second connector member, each of the second pair of second bosses comprising a second spherical shaped cavity, and a rod member including a first coupling part connected to a second coupling part by a rod part, wherein the first coupling part is configured to be inserted into the first spherical shaped cavity so as to pivotably connect the rod member to the first connector member, and the second coupling part is configured to be inserted into the second spherical shaped cavity so as to pivotably connect the rod member to the second connector member, wherein, when the first coupling part is inserted into the first spherical shaped cavity and the second coupling part is inserted into the second spherical shaped cavity, the rod member is pivotable with respect to the first connector member and the second connector member to vary an angle of inclination between the first reference line and the second reference line, wherein the rod member is prohibited from pivoting with respect to the first connector member and the second connector member when the rod member is connected to the first connector member and the second connector member, and the base member is connected to the first connector member and the second connector member, and wherein, when the first reference line is aligned with the second reference line, a pitch between the second protrusion of the first connector member and the other second protrusion of the second connector member is equal to a pitch between the first boss and the other first boss of the base member.

13. The assembly set according to claim 12, wherein the cylindrical part comprises three columnar protrusions, including the first protrusion, that extend from the top portion of the cylindrical part, each of the three columnar protrusions having a diameter equal to the width of the first protrusion.

14. The assembly set according to claim 13, further comprising a second base member comprising a second cylindrical part including an annular space formed between a boss and an inner peripheral surface of the second cylindrical part, wherein the three columnar protrusions of the cylindrical part are configured to be inserted into the annular space of the second cylindrical part when the base member is connected to the second base member.

15. The assembly set according to claim 12, wherein an inner peripheral surface of the opening in the first boss comprises three flat face portions that alternate with and are connected between three arced face portions, and wherein a wall thickness of the first boss increases from a minimum value at the three arced face portions of the inner peripheral surface to a maximum value at the three flat face portions.

16. The assembly set according to claim 12, wherein the cylindrical part of the base member has a first thickness measured from a lower surface of the peripheral wall to an upper surface of the top portion, wherein the connection part has a second thickness measured from the lower surface of the peripheral wall to an upper surface of the connection part, and wherein the second thickness is approximately half of the first thickness.

17. The assembly set according to claim 16, wherein the connection part comprises a curved side surface, wherein the peripheral wall of the cylindrical part has an exterior surface, and wherein a radius of curvature of the curved side surface of the connection part is equal to a radius of curvature of the exterior surface of the cylindrical part.

18. The assembly set according to claim 12, wherein the rod member has a minimum diameter at a connection point between the rod part and the first coupling part, and wherein each of the first pair of second bosses of the first connector member comprises an arcuate cutout portion sized to receive the connection point of the rod member.

19. The assembly set according to claim 18, wherein each of the first pair of second bosses of the first connector member has an axial centerline which passes through a center of the first connector member, wherein an outer edge of the first pair of second bosses is configured to limits an angle of inclination of the rod member relative to the axial centerline, and wherein the arcuate cutout portion is configured to provide for an increased angle of inclination of the rod member as compared to the outer edge of the first pair of second bosses when the rod member is pivoted towards the arcuate cutout portion.

20. The assembly set according to claim 12, wherein the rod member has an axial centerline which passes through a center of the rod member, wherein the axial center line, the first reference line, and the second reference line are aligned when the rod member is connected to the first connector member and the second connector member, and the base member is connected to the first connector member and the second connector member.

* * * * *